US009890716B2

(12) United States Patent
Glugla

(10) Patent No.: US 9,890,716 B2
(45) Date of Patent: Feb. 13, 2018

(54) METHOD AND SYSTEM FOR PRE-IGNITION CONTROL

(71) Applicant: Ford Global Technologies, LLC, Dearborn, MI (US)

(72) Inventor: Chris Paul Glugla, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 289 days.

(21) Appl. No.: 14/604,279

(22) Filed: Jan. 23, 2015

(65) Prior Publication Data

US 2016/0215706 A1 Jul. 28, 2016

(51) Int. Cl.

| | |
|---|---|
| ***F02D 15/04*** | (2006.01) |
| ***F02D 15/02*** | (2006.01) |
| *F02D 35/02* | (2006.01) |
| *F02D 13/02* | (2006.01) |
| *F02B 75/04* | (2006.01) |
| *F02B 75/02* | (2006.01) |

(52) U.S. Cl.

CPC ..... *F02D 15/02* (2013.01); *F02D 35/02* (2013.01); *F02B 75/04* (2013.01); *F02B 2075/025* (2013.01); *F02D 13/0269* (2013.01); *F02D 15/04* (2013.01); *F02D 35/027* (2013.01)

(58) Field of Classification Search

CPC ..... F02D 15/04; F02D 15/02; F02D 13/0269; F02B 75/04; F02B 2075/025

USPC ..... 123/48 R

See application file for complete search history.

(56) References Cited

U.S. PATENT DOCUMENTS

| | | | | |
|---|---|---|---|---|
| 5,215,059 | A | 6/1993 | Kaneyasu | |
| 5,433,179 | A | 7/1995 | Wittry | |
| 5,632,247 | A | 5/1997 | Hashizume et al. | |
| 6,125,801 | A | 10/2000 | Mendler | |
| 6,947,830 | B1 * | 9/2005 | Froloff | F02D 35/023 701/111 |
| 7,640,911 | B2 | 1/2010 | Pien | |
| 8,073,613 | B2 | 12/2011 | Rollinger et al. | |
| 8,260,530 | B2 | 9/2012 | Rollinger et al. | |
| 8,463,533 | B2 | 6/2013 | Glugla et al. | |
| 8,731,799 | B2 | 5/2014 | Makino et al. | |
| 2002/0152985 | A1 * | 10/2002 | Wolff | F02D 19/0631 123/305 |
| 2004/0089253 | A1 * | 5/2004 | Glugla | F02D 15/02 123/78 E |

(Continued)

FOREIGN PATENT DOCUMENTS

EP 1715179 A2 10/2006

OTHER PUBLICATIONS

Glugla, Chris P. et al.,"Method and System for Pre-Ignition Control," U.S. Appl. No. 14/514,142, filed Oct. 14, 2014, 50 pages.

*Primary Examiner* — Jacob Amick
*Assistant Examiner* — Charles Brauch
(74) *Attorney, Agent, or Firm* — Julia Voutyras; McCoy Russell LLP

(57) ABSTRACT

Methods and systems are provided for addressing pre-ignition by mechanically varying a piston displacement within a combustion chamber. In response to pre-ignition, a static compression ratio may be reduced until a threshold lower compression ratio is reached. Further pre-ignition is then addressed with enrichment, thereby reducing the amount of pre-ignition mitigating enrichment required overall.

18 Claims, 7 Drawing Sheets

(56) References Cited

U.S. PATENT DOCUMENTS

| | | | | |
|---|---|---|---|---|
| 2007/0119390 | A1* | 5/2007 | Herrmann | F02D 19/081 123/1 A |
| 2007/0163526 | A1* | 7/2007 | Sugiura | F01L 1/352 123/90.17 |
| 2010/0108031 | A1* | 5/2010 | Pursifull | F02P 5/1508 123/406.5 |
| 2011/0005496 | A1* | 1/2011 | Hiraya | F02D 15/02 123/48 B |
| 2011/0239986 | A1 | 10/2011 | Shishime et al. | |
| 2013/0139786 | A1* | 6/2013 | Glugla | F02D 41/0087 123/321 |
| 2014/0116395 | A1 | 5/2014 | Blackstock | |

* cited by examiner

| Load ↓ | CR_low | | | |
|---|---|---|---|---|
| 1.5 | 8.5 | 8.5 | 8.5 | 8.5 |
| 1.0 | 9 | 9 | 9.5 | 10 |
| 0.5 | 10 | 10 | 12 | 12 |
| 0.1 | 12 | 12 | 14 | 14 |
| Ne → | 1000 | 2000 | 3000 | 4000 |

| Load ↓ | CR_high | | | |
|---|---|---|---|---|
| 1.5 | 13.5 | 13.5 | 13.5 | 14 |
| 1.0 | 14 | 14 | 14.5 | 15 |
| 0.5 | 14.5 | 14.5 | 15 | 15 |
| 0.1 | 15 | 15 | 15 | 15 |
| Ne → | 1000 | 2000 | 3000 | 4000 |

METHOD AND SYSTEM FOR PRE-IGNITION CONTROL

FIELD

The present description relates generally to methods and systems for controlling an engine compression ratio in response to abnormal combustion in an engine system configured with adjustable piston displacement.

BACKGROUND/SUMMARY

Under certain operating conditions, engines that have high compression ratios, or are boosted to increase specific output, may be prone to low speed abnormal combustion events, such as due to pre-ignition. The early abnormal combustion due to pre-ignition can cause very high in-cylinder pressures, and can result in combustion pressure waves similar to combustion knock, but with larger intensity. Such abnormal combustion events can cause rapid engine degradation. Accordingly, strategies have been developed for early detection and mitigation of abnormal combustion events based on engine operating conditions.

One example approach is illustrated by Shishime et al in US 20110239986. Therein, in response to an indication of pre-ignition and further based on an engine speed at which the indication was received, an engine controller is configured to adjust a fuel injection amount and timing to enrich the affected cylinder and optionally reduce the effective compression ratio. In another example, illustrated by Makino et al. in U.S. Pat. No. 8,731,799, an intake cam is advanced to vary the intake valve timing and reduce the effective compression ratio of the engine. In still other cases, wastegate and/or throttle adjustments may be used to vary the effective compression ratio of the engine. Specifically, the intake airflow and thereby the engine load is reduced. In both cases, the resulting drop in effective compression ratio addresses the pre-ignition by decreased compression causing a decreased temperature rise.

However, the inventors herein have identified potential issues with such approaches. The adjustments that reduce the compression ratio may affect engine performance adversely. As an example, the fuel injection enrichment may degrade fuel economy, degrade exhaust emissions, and result in possible torque reduction is the richness is richer than RBT. Cam timing adjustments may also result in loss of fuel economy. As another example, the advance in intake cam timing may result in residual effects that eventually further exacerbate pre-ignition by increasing residuals.

To address the above-mentioned issues, the inventors herein have developed a method for mitigating pre-ignition in an engine comprising: in response to an indication of pre-ignition, adjusting a piston displacement to reduce an engine compression ratio. In this way, abnormal combustion due to pre-ignition may be addressed by taking advantage of variable piston displacement while fueling and valve timing is maintained.

As an example, a vehicle may be configured with a variable compression ratio engine. Specifically, each cylinder of the engine may include a piston coupled to a piston displacement changing mechanism that moves the pistons closer to or further from the cylinder head, thus changing the size of the combustion chambers. By changing the size of the piston displacement, the static compression ratio of the engine (that is, a volume of the cylinder when the piston is at Bottom Dead Center relative to the volume of the cylinder when the piston is at Top Dead Center) may be varied. In one example, the piston connecting rod may be coupled to a hinged block or an eccentric shaft such that a displacement of the piston within the cylinder can be adjusted. In another example, an eccentric may be coupled to a piston pin, the eccentric changing the displacement of the piston within the combustion chamber. Movement of the eccentric may be controlled by oil passages in the rod. It will be appreciated that still other mechanisms that mechanically alter the displacement of the piston within the combustion chamber may be used without departing from the scope of this invention. By adjusting the displacement of the piston, an effective (static) compression ratio of the engine can be varied. During nominal engine operating conditions, the engine may be operated with a piston displacement that provides a nominal compression ratio. Based on the pre-ignition history of the engine (that is, before an indication of pre-ignition is received), the piston displacement may be reduced to lower the compression ratio to a feedback level. By adjusting the piston displacement to reduce the compression ratio in a feedback manner responsive to pre-ignition history, the engine's propensity for pre-ignition may be lowered. In response to an actual pre-ignition event (for example, an event occurring even after the compression ratio is lowered to the feedback level), the compression ratio of the engine may be immediately further reduced by decreasing the displacement of the piston. The reduction in compression ratio responsive to the pre-ignition event may lower the compression ratio to a mitigation level that is lower than the feedback level. By immediately reducing the compression ratio of the engine responsive to pre-ignition incidence, further abnormal cylinder combustion events may be reduced. Specifically, the reduced compression may reduce the thermodynamic rise of temperature due to a lower pressure rise from reduced compression stroke piston displacement. At the same time, fuel injection amount and timing may be maintained while a cylinder combustion air-fuel ratio is held at or around stoichiometry. Likewise, intake valve timing may also be maintained. The amount of compression ratio reduction applied may be based on the indication of pre-ignition. For example, as a knock sensor output exceeds a pre-ignition threshold and/or as a pre-ignition count or pre-ignition frequency of the engine exceeds a threshold, the piston displacement may be reduced until a threshold compression ratio is reached. Below the threshold compression ratio, engine performance may be affected. Therefore, once the threshold compression ratio is reached, further pre-ignition may be addressed by enriching the engine (e.g., enriching only the affected cylinder) and/or varying valve timing.

In still further instances, the piston displacement induced reduction in compression ratio may be based on the engine speed at which the pre-ignition occurs. For example, when pre-ignition occurs at higher engine speeds, or during transient conditions, piston displacement may not be able to reduce the compression ratio rapidly enough. During such conditions, at least some cylinder enrichment may be applied before the compression ratio is reduced via piston displacement. Following pre-ignition mitigation, as a duration of engine operation with no pre-ignition increases, the engine enrichment and/or load limiting may be reduced to return the engine operation to stoichiometry with no load limiting. Thereafter, in response to no further pre-ignition, the compression ratio of the engine may be returned to the nominal value by gradually increasing piston displacement.

In this way, abnormal cylinder combustion due to pre-ignition may be addressed by varying piston displacement and without changing fuel and valve settings. By reducing the compression ratio of the engine responsive to pre-ignition by rapidly reducing the piston displacement, pre-ignition may be mitigated without relying only on enrichment and load limiting, thereby improving fuel economy and engine performance even while the pre-ignition is addressed. By holding the lower compression ratio for a subsequent duration or distance of vehicle travel until no further incident of pre-ignition occurs, engine degradation due to pre-ignition can be reduced and engine life can be improved. By subsequently returning the compression ratio to a nominal value as pre-ignition incidence drops, engine performance issues resulting from a transient decrease in compression ratio can be reduced. In addition, fuel economy is increased while exhaust emissions are reduced. By reducing the risk of further pre-ignition, unwanted NVH issues associated with pre-ignition events are also reduced.

The above discussion includes recognitions made by the inventors and not admitted to be generally known. Thus, it should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for mitigating pre-ignition in an engine configured with a piston whose displacement within a combustion chamber can be varied. As described with reference to the engine system of FIG. 1, the variable piston displacement allows for a compression ratio of the engine to be varied. An engine controller may be configured to perform a control routine, such as the routine of FIG. 2, to reduce the compression ratio level of the engine from a nominal level to a first lower level based on a pre-ignition propensity of the engine, as determined based on the engine's pre-ignition history. The controller may then further reduce the compression ratio level of the engine from the first level to a second level responsive to an incidence of pre-ignition. The controller may further coordinate pre-ignition mitigation via compression ratio reduction with other mitigating actions such as cylinder enrichment and load limiting, as discussed at FIG. 6. For example, the controller may reduce the compression ratio to a threshold level before cylinder enrichment or engine load limiting is applied, thereby reducing the impact of pre-ignition mitigation on enginer performance and fuel economy. As elaborated with reference to FIGS. 3-5, the controller may determine an amount of engine load limiting to be applied, as well as fueling adjustments to be applied, based on the determined compression ratio reduction. In addition, the controller may return the engine compression ratio and piston displacement towards nominal levels as a duration of engine operation without pre-ignition occurrence increases. An example pre-ignition mitigating operation is described at FIG. 7.

Figure 1:
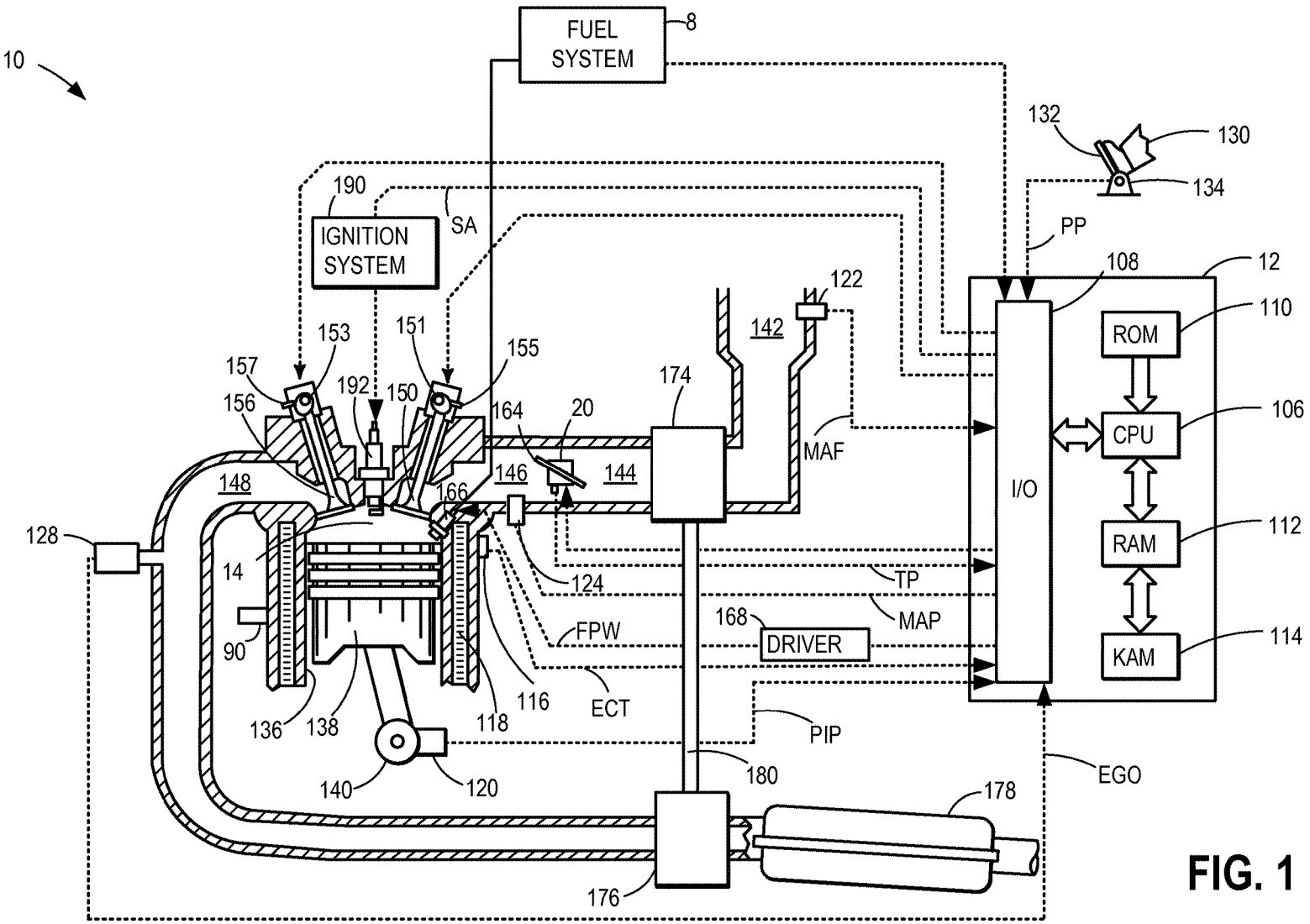
FIG. 1 shows a partial engine view.

FIG. 1 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Specifically, piston 138 may be coupled to crankshaft 140 such via a piston displacement changing mechanism that moves the pistons closer to or further from the cylinder head, thus changing the size of combustion chamber 14. For example, crankshaft 140 may be configured as an eccentric shaft. In another example, an eccentric may be coupled to, or in the area of, a piston pin, the eccentric changing the displacement of the piston within the combustion chamber. Movement of the eccentric may be controlled by oil passages in the piston rod. It will be appreciated that still other mechanisms that mechanically alter the displacement of the piston within the combustion chamber may be used. By adjusting the displacement of the piston, an effective (static) compression ratio of the engine (that is a difference between cylinder volume at TDC relative to BDC) can be varied. As elaborated herein, changes in the piston displacement and the resulting change in engine compression ratio may be advantageously used to address pre-ignition. Specifically, during nominal conditions, the piston displacement may be set to a nominal or maximum level that provides a nominal compression ratio. Then, based on the engine's pre-ignition propensity (e.g., pre-ignition count or history), the piston displacement may be reduced to lower the compression ratio from the nominal level by a first, smaller amount. By reducing the compression ratio, a distance between a top of the piston from a cylinder head is increased. In comparison, in response to a pre-ignition event, the piston displacement may be further reduced to lower the compression ratio from the nominal level by a second, larger amount. In addition, cylinder enrichment and engine load limiting actions may be coordinated with the change in piston displacement. Example methods used are discussed with reference to FIGS. 2-7.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder. Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injector 166 may be a port injector providing fuel into the intake port upstream of cylinder 14.

It will also be appreciated that while the depicted embodiment illustrates the engine being operated by injecting fuel via a single direct injector; in alternate embodiments, the engine may be operated by using two injectors (for example, a direct injector and a port injector) and varying a relative amount of injection from each injector.

Fuel may be delivered by the injector to the cylinder during a single cycle of the cylinder. Further, the distribution and/or relative amount of fuel delivered from the injector may vary with operating conditions. Furthermore, for a single combustion event, multiple injections of the delivered fuel may be performed per cycle. The multiple injections may be performed during the compression stroke, intake stroke, or any appropriate combination thereof. Also, fuel may be injected during the cycle to adjust the air-to-injected fuel ratio (AFR) of the combustion. For example, fuel may be injected to provide a stoichiometric AFR. An AFR sensor may be included to provide an estimate of the in-cylinder AFR. In one example, the AFR sensor may be an exhaust gas sensor, such as EGO sensor 128. By measuring an amount of residual oxygen (for lean mixtures) or unburned hydrocarbons (for rich mixtures) in the exhaust gas, the sensor may determine the AFR. As such, the AFR may be provided as a Lambda ($\lambda$) value, that is, as a ratio of actual AFR to stoichiometry for a given mixture. Thus, a Lambda of 1.0 indicates a stoichiometric mixture, richer than stoichiometry mixtures may have a lambda value less than 1.0, and leaner than stoichiometry mixtures may have a lambda value greater than 1.

As described above, FIG. 1 shows only one cylinder of a multi-cylinder engine. As such each cylinder may similarly include its own set of intake/exhaust valves, fuel injector(s), spark plug, etc.

Fuel tanks in fuel system 8 may hold fuel with different fuel qualities, such as different fuel compositions. These differences may include different alcohol content, different octane, different heat of vaporizations, different fuel blends, and/or combinations thereof etc.

Engine 10 may further include a knock sensor 90 coupled to each cylinder 14 for identifying abnormal cylinder combustion events. In alternate embodiments, one or more knock sensors 90 may be coupled to selected locations of the engine block. The knock sensor may be an accelerometer on the cylinder block, or an ionization sensor configured in the spark plug of each cylinder. The output of the knock sensor may be combined with the output of a crankshaft acceleration sensor to indicate an abnormal combustion event in the cylinder. In one example, based on the output of knock sensor 90 in a one or more defined windows (e.g., crank angle timing windows), abnormal combustion due to one or more of knock and pre-ignition may be addressed. In particular, the severity of a mitigating action applied may be adjusted to address an occurrence of knock and pre-ignition, as well as to reduce the likelihood of further knock or pre-ignition events.

Based on the knock sensor signal, such as a signal timing, amplitude, intensity, frequency, etc., and further based on the crankshaft acceleration signal, the controller may address abnormal cylinder combustion events. For example, the controller may identify and differentiate abnormal combustion due to knock and/or pre-ignition. As an example, pre-ignition may be indicated in response to knock sensor signals that are generated in an earlier window (e.g., before a cylinder spark event) while knock may be indicated in response to knock sensor signals that are generated in a later window (e.g., after the cylinder spark event). Further, pre-ignition may be indicated in response to knock sensor output signals that are larger (e.g., higher than a first threshold), and/or less frequent while knock may be indicated in response to knock sensor output signals that are smaller (e.g., higher than a second threshold, the second threshold lower than the first threshold) and/or more frequent. Additionally, pre-ignition may be distinguished from knock based on the engine operating conditions at the time of abnormal combustion detection. For example, high knock intensities at low engine speed may be indicative of low speed pre-ignition.

In other embodiments, abnormal combustion due to knock and pre-ignition may be distinguished based on the output of the knock sensor in a single defined window. For example, pre-ignition may be indicated based on the output of the knock sensor being above a threshold in an earlier part of the window while knock is indicated based on the output of the knock sensor being higher than the threshold in a later part of the window. Furthermore, each window may have differing thresholds. For example, a first higher threshold may be applied in the first (earlier) pre-ignition window while a second, lower threshold is applied in the second (later) knock window.

Mitigating actions taken to address knock may differ from those taken by the controller to address pre-ignition. For example, knock may be addressed using spark retard and EGR while pre-ignition is addressed using a reduction in compression ratio (by reducing piston displacement within the combustion chamber), cylinder enrichment, cylinder enleanment, engine load limiting (by reducing intake airflow), and/or delivery of cooled external EGR.

Returning to FIG. 1, Controller 12 is shown as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; absolute manifold pressure signal (MAP) from sensor 124, cylinder AFR from EGO sensor 128, and abnormal combustion from knock sensor 90 and a crankshaft acceleration sensor. Engine speed signal, RPM, may be generated by controller 12 from signal PIP. Manifold pressure signal MAP from a manifold pressure sensor may be used to provide an indication of vacuum, or pressure, in the intake manifold.

Non-transitory storage medium read-only memory 110 can be programmed with computer readable data representing instructions executable by processor 106 for performing the methods described below as well as other variants that are anticipated but not specifically listed.

Figure 2:
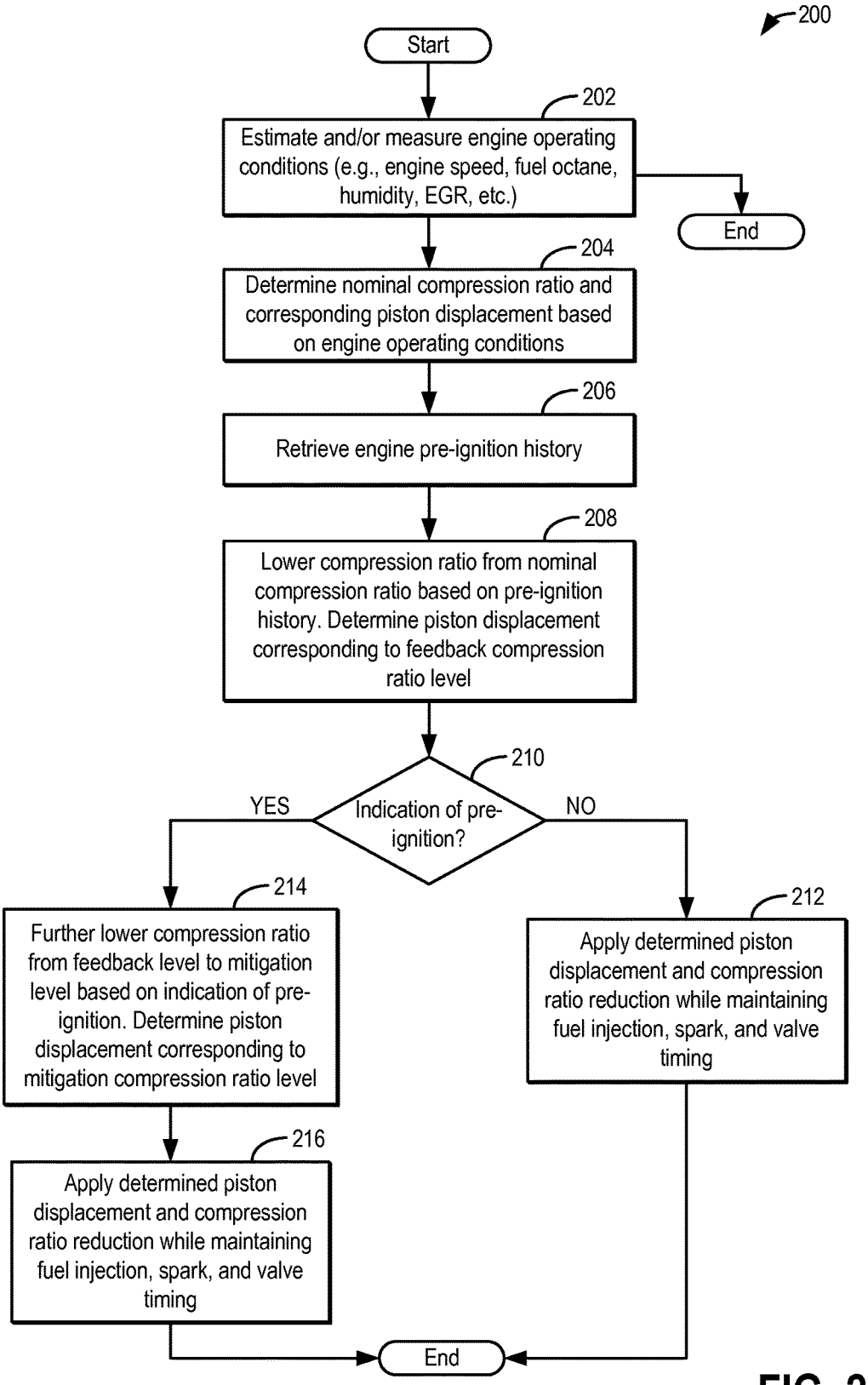
FIG. 2 shows a high level flow chart for adjusting a compression ratio level of the engine responsive to pre-ignition history and occurrence.

Now turning to FIG. 2, an example routine 200 is described for adjusting a compression ratio level in an engine configured with a piston whose displacement within the combustion chamber can be varied. The compression ratio level may be adjusted based on an indication of pre-ignition (including pre-ignition incidence and pre-ignition propensity) to mitigate the abnormal combustion and reduce the likelihood of further incidences of abnormal combustion due to pre-ignition (as well as incidences of knock or misfire induced by the original pre-ignition event).

At 202, the routine includes estimating and/or measuring engine operating conditions. These may include, for example, engine speed, EGR amount (e.g., cooled LP-EGR amount, HP-EGR to LP-EGR ratio, etc.), engine dilution, fuel octane rating, fuel alcohol content, ambient temperature, pressure and humidity, boost level, etc. At 204, based on the determined engine operating conditions, a nominal compression ratio may be determined. The nominal compression ratio may correspond to the highest compression ratio possible for the given operating conditions. In addition to the nominal compression ratio, a (first) piston displacement corresponding to the nominal compression ratio may also be determined. In one example, the piston displacement corresponding to the nominal compression ratio may include a maximum piston displacement, wherein the piston moves all the way to the cylinder head in the combustion chamber.

The nominal compression ratio may also be determined based on spark timing at the current operating conditions. For example, the nominal compression ratio may be adjusted based on MBT relative to borderline (BDL) spark. Consequently, the nominal compression ratio may not always be the highest possible compression ratio since the highest compression ratio may not always result in the best fuel economy. As an example, a lower nominal compression ratio may be applied while holding spark timing closer to MBT to achieve improves fuel economy instead of applying a higher nominal compression ratio while retarding spark from MBT (in relation to BDL).

At 206, the routine includes retrieving a pre-ignition history of the engine. For example, an engine pre-ignition count may be retrieved. The engine pre-ignition count may include an overall pre-ignition count for the engine. In addition, pre-ignition counts for individual cylinders may also be retrieved. As such, the pre-ignition count of the engine (or cylinder) may reflect their propensity for pre-ignition. Thus, as the pre-ignition count increases, the likelihood of pre-ignition occurrence in the engine (or given cylinder) may be higher. It will be appreciated that the pre-ignition history of the engine may reflect the propensity of the engine to pre-ignite before an actual incidence of pre-ignition is confirmed on the current engine combustion cycle (or current iteration of the routine).

At 208, based on feedback regarding the pre-ignition history of the engine, the nominal compression ratio may be reduced (or clipped) to a feedback level. Specifically, the compression ratio may be reduced from the first nominal level to a second feedback level (lower than the nominal level), the reduction based on the pre-ignition history. Thus, as the pre-ignition count of the engine increases, and the propensity for the engine to pre-ignite increases, the feedback compression ratio level may be lowered further from the nominal compression ratio level. The reduction may be gradual based on the pre-ignition count. Alternatively, as the pre-ignition count increases by a threshold amount, the compression ratio may be reduced (stepwise) by a pre-defined amount. In addition to determining the feedback compression ratio level, a piston displacement corresponding to the feedback compression ratio level may also be determined. In one example, the piston displacement corresponding to the feedback compression ratio may include a less than maximum piston displacement, wherein the piston moves close to (but not all the way to) the cylinder head in the combustion chamber. In other words, a first distance or space may be defined between the cylinder head and a final position (e.g., TDC) of the piston.

It will be appreciated that if the pre-ignition count of the engine is less than a threshold (e.g., the pre-ignition count is 0), then the nominal compression ratio may be maintained and no further reduction may be required.

At 210, it may be determined if there is an indication of pre-ignition. Specifically, it may be determined if an actual pre-ignition event has occurred on the current engine combustion cycle (or current iteration of the routine). In one example, an indication of pre-ignition may be confirmed based on output from an engine knock sensor. Specifically, during each cylinder combustion event, knock sensor output generated in each of a first, pre-ignition window and a second, knock window may be assessed against respective first and second thresholds to identify and distinguish abnormal combustion due to pre-ignition from abnormal combustion due to knock. The knock sensor may be coupled to the cylinder undergoing the cylinder combustion event, or may be coupled to an engine block. In addition, the output of any signals generated by the knock sensor outside the defined windows may be disregarded.

The first and second windows may be crank angle timing windows and the first window may partially overlap the second window. For example, a start timing of the first window may be before a spark event for the given cylinder combustion event (e.g., at 15 degrees BTDC), and the end timing of the first window may be in the expansion stroke of the given cylinder combustion event (e.g., at 40 degrees ATC). In comparison, a start timing of the second window may be after the spark event and the end timing of the second window may be after the end of the first window. The windows may be adjusted so as to capture a variety of abnormal combustion events, such as those due to cylinder knock, cylinder misfire, as well as those due to cylinder pre-ignition. In one example, a size of the windows may be adjusted based on engine speed. Further, a size of the windows may be adjusted relative to one another. For example, the second window may have an absolute valve relative to TDC and the first window may be calibrated based on the second window, or the first window may have an absolute valve relative to TDC and the second window may be calibrated based on the first window. As an example, the first window may be calibrated to end 3.0 CA degrees before the second window ends at engine speeds from 0-1500 rpm, and calibrated to end 2.5 CA degrees before the second window ends at engine speeds from 1500-2500 rpm. Based on the output of the first, pre-ignition window being higher than the first pre-ignition threshold, an indication of pre-ignition may be confirmed.

In still other example, the indication of pre-ignition may be based on the output of an ionization sensor and/or a pressure sensor coupled to the engine block, wherein a peak knocking pressure may be used to infer pre-ignition. Further still, the indication of pre-ignition may include one or more of a pre-ignition count of the engine, an output of a knock sensor, an intensity of pre-ignition, an amplitude of pre-ignition, and a frequency of pre-ignition.

If an indication of pre-ignition is not confirmed, it may be determined that an incidence of pre-ignition has not occurred and at 212, the previously determined compression ratio level and corresponding piston displacement may be applied. This may include applying the nominal compression ratio and enabling maximum piston displacement when the pre-ignition count of the engine is less than a threshold (e.g., the pre-ignition count is 0). Alternatively, this may include applying the feedback compression ratio level and enabling the less than maximum piston displacement when the pre-ignition count of the engine is more than the threshold (e.g., the pre-ignition count is above 0).

If an indication of pre-ignition is confirmed, then at 214, the routine includes further reducing (or clipping) the engine compression ratio from each of the nominal and feedback level to a mitigation level. Specifically, the compression ratio may be reduced from the second feedback level (lower than the first nominal level) to a third mitigation level (lower than each of the first nominal level and the second feedback level), the reduction based on the current (that is, most recent) indication of pre-ignition. The third mitigation level may be a pre-defined compression ratio level applied responsive to any indication of pre-ignition. The third mitigation level may correspond to a threshold (minimum) compression ratio level below which engine performance is affected. Alternatively, the third mitigation level may be higher than the (minimum) compression ratio level.

Thus, as the pre-ignition indication increases (e.g., as the output of the knock sensor in the first, pre-ignition window exceeds the first, pre-ignition threshold), the mitigation compression ratio level may be lowered further from the feedback compression ratio level (and therefore also from the nominal compression ratio level). In addition to determining the mitigation compression ratio level, a piston displacement corresponding to the mitigation compression ratio level may also be determined. In one example, the piston displacement corresponding to the mitigation compression ratio may include a less than maximum piston displacement (e.g., a minimum piston displacement), wherein the piston moves further away from the cylinder head in the combustion chamber. In other words, a second distance or space may be defined between the cylinder head and a final position (e.g., TDC) of the piston during the mitigation level, the second distance larger than the first distance defined when the piston is displaced to the feedback compression ratio level.

At 216, the determined compression ratio level and corresponding piston displacement may be applied. Specifically, the mitigation compression ratio and the corresponding piston displacement may be applied.

In this way, the piston displacement of a variable compression ratio may be varied responsive to a propensity for pre-ignition as well as an actual occurrence of pre-ignition, By reducing the compression ratio based on an indication of pre-ignition, abnormal combustion may be addressed with a lower dependence on cylinder enrichment and engine load limiting.

It will be appreciated that the controller may select a compression ratio, and corresponding piston displacement, that corresponds to the lowest of the compression ratios based on the pre-ignition history, the compression ratio required for pre-ignition mitigation, and the nominal (or optimal) compression ratio at a given spark MBT/BDL limit. As such, the nominal compression ratio may not always be the highest compression ratio since the highest compression ratio may not always result in the best fuel economy. For example, if at a given compression ratio, the spark retard from MBT due to borderline spark reduces the fuel consumption enough, it may be better to be operating the engine at a lower (nominal) compression ratio while holding spark timing closer to MBT.

As used herein, compression ratio reduction via adjustments to the piston displacement may be applied to only the pre-ignition affected cylinder, or one or more additional cylinders, the selection based on the indication of pre-ignition. For example, when the compression ratio is reduced from the nominal level to the feedback level based on a pre-ignition history of the engine (but before an incidence of pre-ignition on the given engine cycle/combustion cycle/vehicle drive cycle), the smaller amount of compression ratio reduction may be applied to all engine cylinders to reduce an overall engine pre-ignition likelihood. Alternatively, the smaller amount of compression ratio reduction may be selectively applied to only the engine cylinders having a pre-ignition count that is higher than a threshold cylinder pre-ignition count. Herein, the compression ratio adjustment is based on the overall engine pre-ignition count (or history) as well as the pre-ignition count (or history) of individual engine cylinders. In comparison, responsive to an incidence of pre-ignition occurring during the given engine cycle/combustion cycle/vehicle drive cycle, the larger amount of compression ratio reduction from the feedback level to the mitigation level may be applied to at least the pre-ignition affected cylinder, and extended to further engine cylinders as the pre-ignition intensity, amplitude, and/or frequency increases. Herein, the compression ratio adjustment is largely based on the change in pre-ignition count of individual engine cylinders.

It will be appreciated that if an individual cylinder compression ratio changes (responsive to pre-ignition), the revised compression ratio may have to be held within a threshold (or range). A deviation to outside the threshold or range may result in noticeable IMEP or torque disturbances, leading to poor NVH. In other words, the revised compression ratio may be held within a threshold distance of the original compression ratio. If the deviation is higher than a threshold, the controller may lower the compression ratio of one or more other cylinders to be within a threshold difference or range from the cylinder(s) that had the pre-ignition event.

Figure 3:
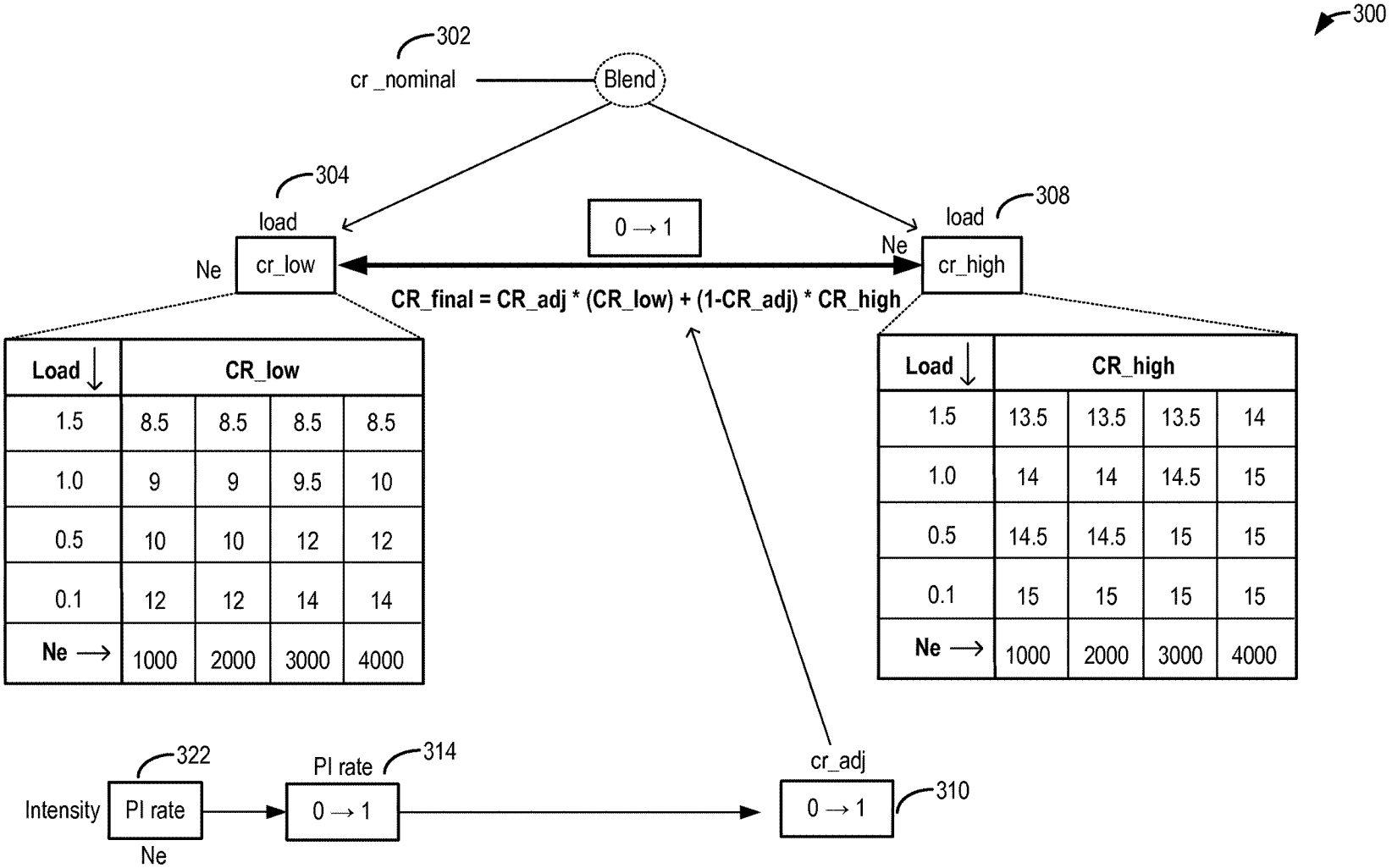
FIGS. 3-5 show block diagrams depicting adjusting of engine compression ratio, load-limiting and enrichment responsive to an indication of pre-ignition.
Figure 4:
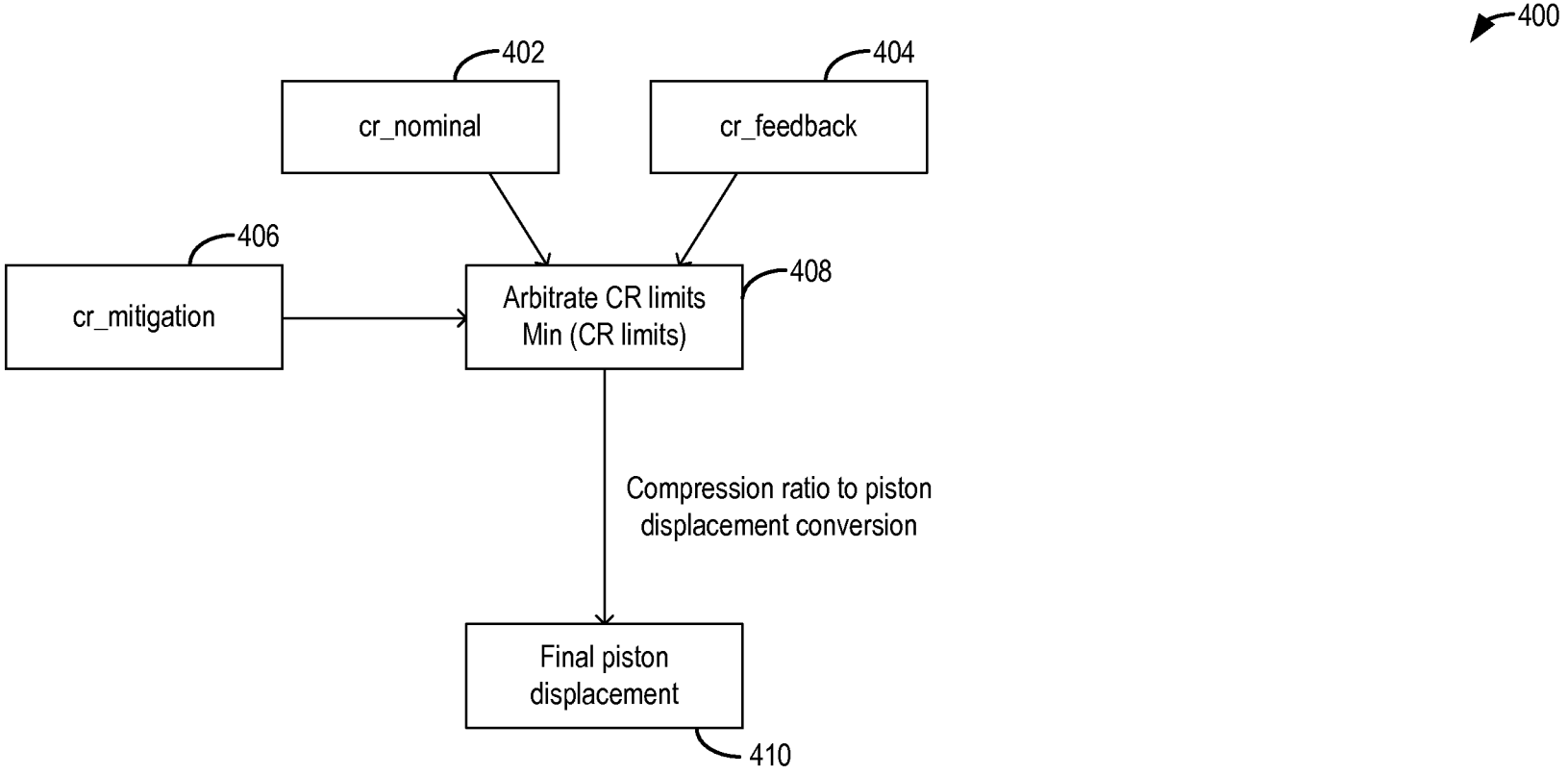
Figure 5:
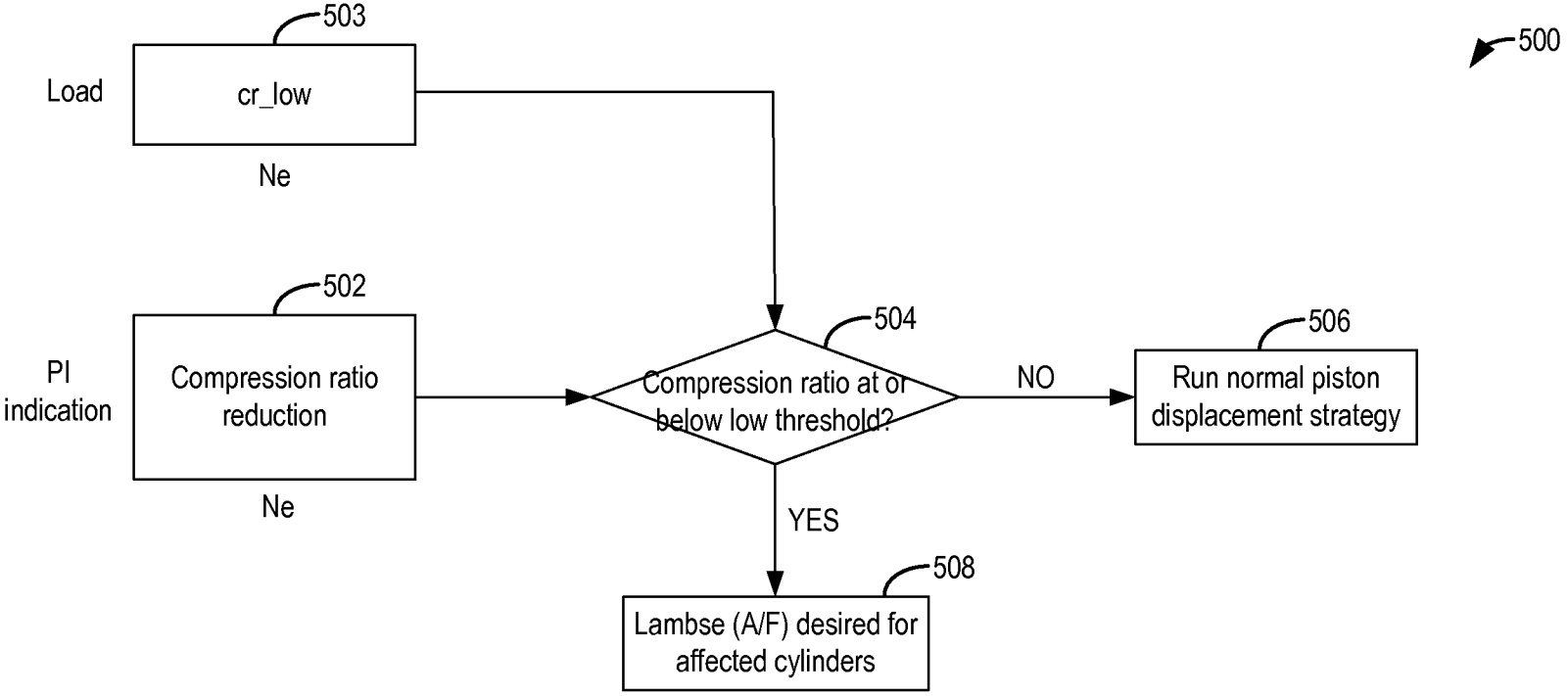
Figure 6:
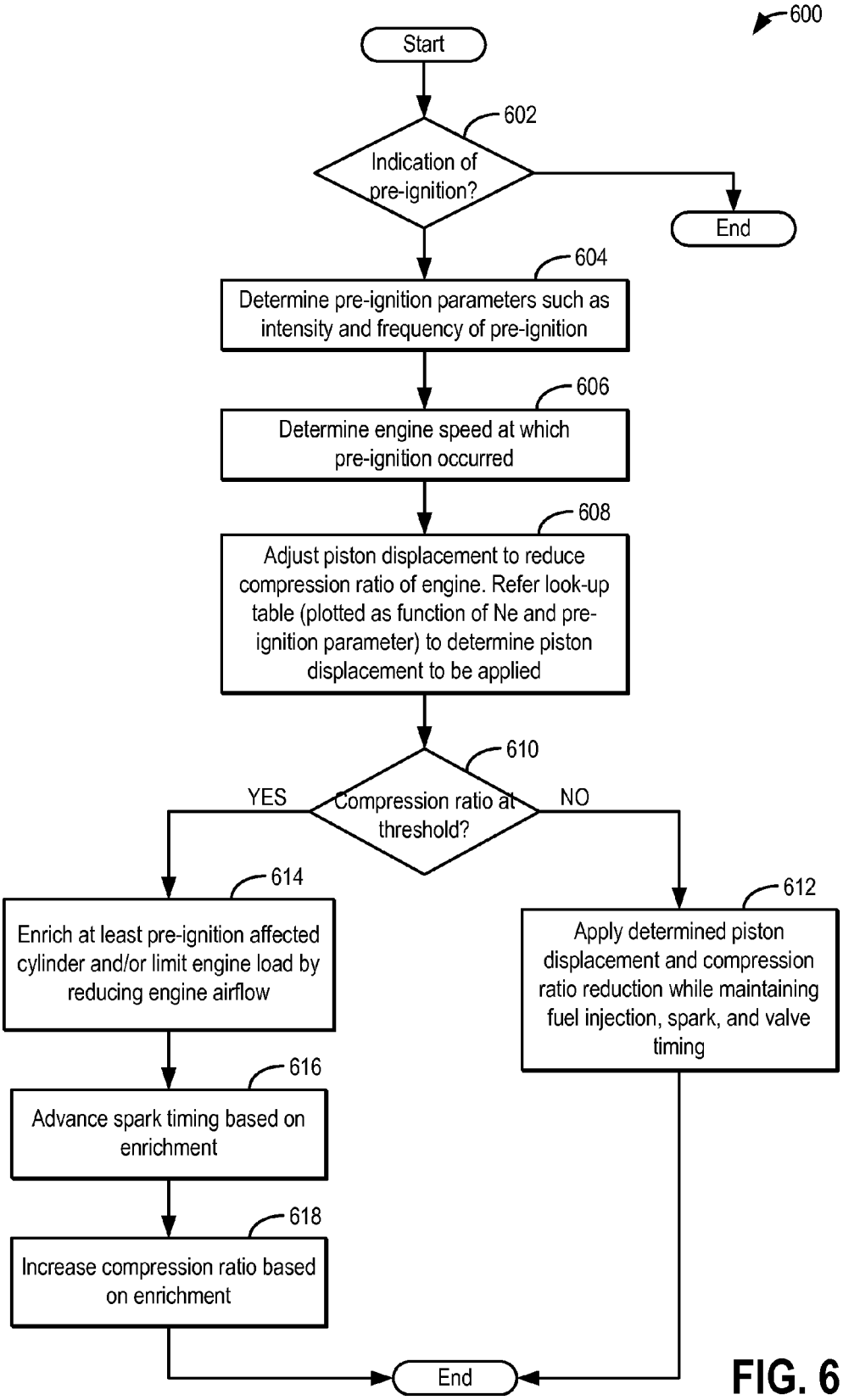
FIG. 6 shows a high level flow chart for adjusting piston displacement of an engine to vary the engine compression ratio responsive to an indication of pre-ignition.

Now turning to FIGS. 3-5, schematic depictions of an engine compression ratio variation routine is shown. The compression ratio adjustment is performed responsive to various factors including pre-ignition.

At FIG. 3, the routine may start with a nominal compression ratio 302 (CR_nominal) determined in a feed-forward manner. Nominal compression ratio 302 is determined based on engine operating conditions, such as based on an engine speed-load conditions. Nominal compression ratio 302 may then be clipped based on various factors so as to minimize negative NVH issues associated with abnormal combustion, such as those associated with low speed pre-ignition events. In addition to controlling NVH, engine damaging knock events are also minimized.

The controller may use two sets of compression ratio (CR) tables including a low compression ratio table (cr_low) 304 (which has a higher effect on abnormal combustion mitigation by relying on a lower compression ratio and smaller piston displacement), and a high compression ratio table (cr_high) 308 (which has a lower effect on abnormal combustion by relying on a higher compression ratio and larger piston displacement). Each of tables 304, and 308 is plotted as a function of engine speed (Ne) and load, and the output of each table is a compression ratio value. Nominal compression ratio 302 is adjusted for changes due to a pre-ignition rate by blending the output of the tables according to the depicted equation (and as elaborated below). In alternate embodiments, the output of the tables may be a multiplier or CR clip wherein the nominal compression ratio may be clipped with the CR clip, to blend the outputs of the tables 304-308. In still further examples, there may be a third nominal condition table that is used in the blending.

A multiplication factor or adjustment factor 310 (or CR_adj) is used to adjust the compression ratio (CR) output from tables 304-308 and interpolate between the low, and high tables. Adjustment factor 310 ranges from 0 to 1. The factor may be based on various feed-forward measurements. For example, the factor may be based on fuel ethanol or alcohol content, fuel octane content, and air-to-fuel ratio (AFR). Thus, a lean air-to-fuel ratio or a low octane fuel that will make the probability of abnormal combustion go higher results in an adjustment factor wherein the interpolation of the CR output moves the CR limit to a lower value (such as towards cr_low table 304). In another example, a rich air-to-fuel ratio or a high octane content of the fuel may result in an adjustment factor wherein the interpolation of the CR output moves the CR limit to a higher value (such as towards cr_high table 308), since the enrichment reduces the probability of abnormal combustion. The CR output also includes the feedback portion of the CR limiting, wherein the CR limit is further adjusted based on PI rate 314. Therein, the PI rate 314 may be incremented on a rate counter based on engine speed and knock sensor output intensity, as shown in table 322. The rate counter or weighting is incremented as the number of pre-ignition incidences (or engine pre-ignition count) increases, and further based on an engine speed at which the knock sensor signal is detected. As the number of abnormal combustion events per vehicle miles driven increases, the rate may be further incremented. The rate may be decreased as the number of miles driven by the vehicle engine increases. As such, with enough miles, the rate can come back to zero and have no effect on CR limiting if no abnormal combustion is observed. However, the operating conditions can affect the anticipation of abnormal combustion and hence the nominal load limit. The CR limit is then arbitrated with the CR output by controller 312 to determine the arbitrated CR limit 310.

For example, the engine controller may apply the adjustment factor to determine a final compression ratio to be applied to the engine responsive to pre-ignition by blending at least the high and low CR tables (304 and 308) according to the equation:

$$CR_final=CR_adj*(cr_low)+(1-CR_adj)*cr_high,$$

wherein CR_final is the determined compression ratio to be applied, cr_low is the high effectiveness CR table with low CR values, and cr_high is the low effectiveness CR table with high CR values.

In parallel, a rate incrementer may be counting the number of compression ratio reduction events that have occurred over an engine cycle, a vehicle drive cycle, a threshold duration or a threshold driven distance. As the number of times the compression ratio is reduced responsive to pre-ignition incidences increases, the rate incrementer may be incremented by a defined amount. Alternatively, a weighting factor may be determined. If the rate incrementer output is high (e.g., higher than a threshold), or if the weighting factor is high (e.g., higher than a threshold), a weighted CR limit may be calculated. This weighted CR limit may have a more aggressive "learn down rate" and may be activated only when a threshold number of pre-ignition events have occurred. In addition, if the compression ratio has been lowered to a minimum compression ratio limit, the controller may address further pre-ignition by applying an air-fuel adjustment strategy. For example, the controller may address further pre-ignition by enriching the engine and/or limiting an engine load by reducing intake airflow to the engine, as discussed with reference to FIG. 6.

An example of such a rate incrementer is shown at map 500 of FIG. 5. Specifically, table 502 determines an amount of compression ratio reduction to be performed as a function of the indication of pre-ignition and the engine speed at which the indication of pre-ignition is received. In one example, the compression ratio reduction may be performed as a function of the output intensity of the knock sensor in the pre-ignition window and an engine speed at which the knock sensor output is received. Also, cr_low table 503 is retrieved which provides input regarding the lowest compression ratio (or threshold CR) that is permissible at a given engine speed-load condition. At 504 it is determined if the compression ratio reduction requested responsive to pre-ignition is to a compression ratio limit that is lower than the threshold compression ratio achievable based on the engine speed-load conditions (e.g., whether the compression ratio is approximately 9 or a lowest achievable compression ratio). If the compression ratio has not been reduced to the lower compression ratio limit, the engine may continue running with the normal compression ratio reduction and piston displacement reduction strategy at 506. For example, the piston displacement may continue to be decreased from the maximum displacement towards a minimum displacement, thereby reducing the compression ratio from the nominal compression ratio towards the compression ratio limit. Else, if the compression ratio lower threshold has been reached, then at 508, air-fuel control for the abnormal combustion affected cylinders is adjusted so that a desired degree of richness and/or engine load limiting can be provided. An example coordination of pre-ignition mitigating enrichment and load-limiting strategies after first reducing a compression ratio to the threshold limit is elaborated at the routine of FIG. 6. It will be appreciated that in still further examples, an enrichment schedule may be initiated as the compression ratio approaches the compression ratio lower threshold and before the compression ratio lower threshold is reached.

Arbitration of compression ratio limits is shown at map 400 of FIG. 4. A controller may first determine compression ratios for the different conditions. This includes a nominal compression ratio 402 (cr_nominal) based on nominal engine operating conditions, a feedback compression ratio 404 (cr_feedback) based on the pre-ignition history of the engine, as well as a mitigation compression ratio 406 (cr_mitigation) based on a most recent incidence of pre-ignition. At 408, a controller may arbitrate the compression ratio limits and select the desired compression ratio to be the lowest (that is, minimum) of compression ratio limits 402-406.

The arbitrated compression ratio then undergoes compression ratio to piston displacement conversion. That is, a final piston displacement 410 corresponding to the arbitrated compression ratio is computed based on the eccentricity of the eccentric shaft that the cylinder pistons are coupled to. For example, a transfer function of compression ratio versus piston displacement may be applied. The final piston displacement is then applied to the engine.

Thus, the final piston displacement and compression ratio applied may be the lowest of the weighted compression ratio limits. By selecting the lowest of the possible compression ratio limits, abnormal combustion is mitigated and further mega-knock events are pre-empted.

In this way, a method for an engine is provided wherein an engine compression ratio is reduced from a first, nominal level to a second level based on a pre-ignition history of the engine and before an incidence of pre-ignition on a current engine cycle. Further, the engine compression ratio is reduced from the second level to a third level responsive to the incidence of pre-ignition on the current engine cycle. Herein, the reduction from the first level to the second level is smaller than the reduction from the second level to the third level. Further, in response to no indication of pre-ignition being received after a threshold duration (or travelled distance) having elapsed since the incidence of pre-ignition, increasing the engine compression ratio towards the first level. Reducing the engine compression ratio may include reducing the displacement of a piston within a cylinder along an eccentric crankshaft or an eccentric in the piston pin area and increasing a distance between a top of the piston from a cylinder head. In one example, the third level is a threshold (minimum) level. In response to a further indication of pre-ignition, the engine may be enriched and/or an engine load may be limited while the compression ratio is maintained at the third level.

Now returning to FIG. 6, an example routine 600 is shown for adjusting a piston displacement to vary a compression ratio of the engine responsive to pre-ignition. Further, additional pre-ignition mitigating actions, such as engine enrichment and engine airflow reduction (to limit engine load) may be coordinated based on the piston displacement.

At 602, the routine includes confirming an indication of pre-ignition. As elaborated with reference to FIG. 2, an indication of pre-ignition may be confirmed based on the output of a knock sensor coupled to the engine being higher than a pre-ignition threshold, the output estimated in a pre-ignition window. If an indication of pre-ignition is not confirmed, the routine may end and the engine may continue to be operated with a nominal compression ratio, nominal fueling, and nominal valve timing.

If an indication of pre-ignition is confirmed, then at 604, the routine includes determining (or retrieving) parameters related to the indication of pre-ignition. For example, a frequency of the pre-ignition may be determined. For example, based on a number of pre-ignition events that have occurred over a threshold duration or threshold distance travelled, it may be determined if the pre-ignition is intermittent (fewer events over the threshold duration) or persistent (more events over the threshold duration). As another example, an intensity of the pre-ignition may be determined (e.g., based on a difference of the output of the knock sensor in the pre-ignition window relative to a pre-ignition threshold). Still other pre-ignition parameters may be determined. At 606, an engine speed at which the indication of pre-ignition was received may be determined.

At 608, in response to the indication of pre-ignition, the routine includes adjusting a piston displacement to reduce an engine compression ratio. Specifically, the adjusting includes reducing the compression ratio towards a threshold ratio as the indication of pre-ignition increases. The compression ratio may be reduce by reducing the piston displacement within a compression chamber via an elliptical crankshaft rotation or an alternate elliptical device (such as an eccentric) coupled to a piston pin area. In further examples, other piston displacement technologies capable of modifying the static compression ratio may be used. The engine controller may refer to a look-up table plotted as a function of engine speed and pre-ignition intensity to determine the compression ratio reduction required, and the corresponding piston displacement. In one example, the compression ratio may be gradually reduced towards to the threshold ratio. In an alternate example, the compression ratio may be immediately lowered to the threshold ratio. In still further examples, at each pre-ignition event, the compression ratio may be reduced by a pre-defined amount. The indication of pre-ignition may include one or more of a pre-ignition count of the engine, an output of a knock sensor, an intensity of pre-ignition, an amplitude of pre-ignition, and a frequency of pre-ignition.

The piston displacement and reduction in compression ratio may also be based on the engine speed at which the indication of pre-ignition was received. For example, a smaller piston displacement and smaller reduction in compression ratio may be applied when the indication of pre-ignition is at a higher engine speed and a larger piston displacement and larger reduction in compression ratio may be applied when the indication of pre-ignition occurs at a lower engine speed.

At 610, it may be determined if the compression ratio is at the threshold ratio. The threshold ratio is a minimum compression ratio that may be applied, below which engine performance may be degraded. Further, the threshold ratio may be a hard limit that is fixed due to the specific configuration of the piston on the eccentric shaft.

If the compression ratio is not at the threshold ratio, then at 612, the routine includes applying the determined compression ratio and corresponding piston displacement while maintaining each of a fuel injection timing (e.g., total opening time), spark timing, and valve timing even as the compression ratio is reduced. For example, spark timing may be maintained at or around MBT, and combustion air-fuel ratio may be maintained at or around stoichiometry. Further, intake and exhaust cams may be maintained at nominal timing. As such, the fuel injection timing may reflect a total opening time, and thereby an amount of fuel delivered to the cylinder. It will be appreciated that it may be possible to deliver the same amount of fuel by opening the injector sooner and closing it sooner, while still affecting engine performance.

After reaching the threshold ratio, at 614, the routine includes, in response to a further indication of pre-ignition, enriching the engine and/or limiting an engine load by reducing intake airflow. Each of the enrichment and the engine load limiting may be based on the reduction in engine compression ratio. For example, a degree of richness of the enrichment as well as a number of enrichment cycles may be adjusted based in the reduction in compression ratio. Further still, a number of engine cylinders that are enriched may be varied. As yet another example, the overall scheduled compression ratio for the given cylinder may be varied. As an example, when a larger amount of compression ratio reduction is applied (e.g., when the compression ratio is reduced to the threshold ratio), a smaller degree of richness and/or a fewer number of enrichment cycles may be required to address the pre-ignition. Further, only the pre-ignition affected cylinder (or a smaller number of additional engine cylinders) may need to be enriched. In doing so, fuel loss incurred during pre-ignition mitigation as well as exhaust emissions may be reduced. In comparison, when a smaller amount of compression ratio reduction is applied (e.g., when substantial compression ratio reduction is not possible), a larger degree of richness and/or a larger number of enrichment cycles may be required to address the pre-ignition. Further, a larger number of engine cylinders in addition to the pre-ignition affected cylinder may need to be enriched (e.g., all engine cylinders may be enriched). Likewise, when the compression ratio is reduced more, a smaller amount of engine load limiting is required to address pre-ignition, while when the compression ratio is reduced less, a larger amount of engine load limiting may be required to address pre-ignition.

The enrichment and the load limiting applied may be further based on the indication of pre-ignition, the degree of richness and/or the number of enrichment cycles applied increased as the pre-ignition intensity or frequency increases. Likewise, engine load may be limited to a lower level as the pre-ignition intensity or frequency increases.

It will be appreciated that if the initial indication of pre-ignition is received while the compression ratio is at or within a predefined range of the threshold (minimum) ratio, the controller may directly transition to using cylinder enrichment and engine load limiting strategies to address the pre-ignition and may not perform any compression ratio reduction. This is because the amount of compression ratio reduction available under such conditions may be limited and may not be sufficient to address the pre-ignition.

At 616, one or more of spark timing, valve timing, and fuel injection timing may be adjusted based on the enrichment. For example, spark timing may be advanced from MBT based on the enrichment and further based on borderline (BDL) spark limits at the current operating conditions. Specifically, based on the enrichment, it may be determined that significant charge cooling benefits may be achieved and spark may be advanced (e.g., operated closer to MBT) to recover some of the torque lost due to cylinder operation at richer than rich for best torque (RBT).

It will be appreciated that in response to no further indication of pre-ignition, the piston displacement may be increased to increase the engine compression ratio from the threshold ratio towards a nominal ratio. The compression ratio may be gradually increased, or immediately returned to the nominal value.

At 618, based on the enrichment, the compression ratio may be increased. For example, as a number of enrichment cycles increases, the compression ratio may be gradually increased towards the nominal (or feedback) compression ratio level from which the compression was reduced responsive to the incidence of pre-ignition. The level to which the compression ratio is returned may be further determined based on the pre-ignition count of the engine. Thus, in response to the pre-ignition count being above a threshold, the compression ratio may be returned to the feedback level (or an alternate compression ratio higher than the mitigation level but lower than the nominal level). In comparison, in response to the pre-ignition count being below the threshold, the compression ratio may be returned to the nominal level. A rate at which the compression ratio is increased to the nominal (or feedback) level may also be based on the pre-ignition count. For example, as the pre-ignition count exceeds the threshold count, the compression ratio may be increased to the feedback level at a slower rate. The compression ratio may then be held at the feedback level until a sufficient duration, distance, number of combustion cycles, or number of enrichment cycles have elapsed with no indication of pre-ignition. Thereafter, the compression ratio may be rapidly returned to the nominal level. An example coordination of enrichment and compression ratio reduction is shown with reference to the map of FIG. 7.

In this way, responsive to an indication of pre-ignition, a controller is configured to first reduce an engine compression ratio via adjustments to a piston displacement until a threshold compression ratio is reached, and thereafter enrich the engine and/or limit an intake airflow. The indication of pre-ignition may include a frequency of pre-ignition, wherein reducing the compression ratio includes reducing the compression ratio at a higher rate when the pre-ignition is persistent and reducing the compression ratio at a lower rate when the pre-ignition is intermittent. The reducing of the compression ratio may be further based on an engine speed at which the indication of pre-ignition is received, the compression ratio reduced by a higher amount at lower engine speeds. Reducing the compression ratio via adjustments to the piston displacement may include reducing a piston displacement within a combustion chamber to reduce the compression ratio. Further, each of fuel injection timing, spark timing, and valve timing may be maintained while reducing the compression ratio. In comparison, one or more of the fuel injection timing, spark timing, and valve timing may be adjusted while enriching the engine and/or limiting the intake airflow. In response to no further indication of pre-ignition being received after enriching the engine and/or limiting the intake airflow, the compression ratio may be increased (e.g., gradually or stepwise) by increasing the piston displacement within the combustion chamber.

In still further embodiments, the adjustment to the compression ratio may be performed primarily (and first) if the adjustment is fast at the prevalent conditions (e.g., during steady-state engine operating conditions). Then, once the compression ratio has been rapidly reduced to the threshold (minimum) compression ratio, further pre-ignition mitigation via enrichment and load clipping may be added. In comparison, if the compression ratio adjustment cannot be performed fast enough at the prevalent conditions, then each of the compression ratio adjustment and engine enrichment may be performed concurrently until the threshold compression ratio is reached. This allows for a faster pre-ignition mitigation. Then, once the threshold compression ratio is reached, further pre-ignition may be addressed via additional cylinder enrichment or engine load limiting. Herein, the enrichment may also be dynamically adjusted with the change in compression ratio. For example, during conditions where the enrichment is applied after the compression ratio reduction, the enrichment may initially be to a smaller degree and may be tapered off slowly. In comparison, during conditions where the enrichment is applied concurrent to the compression ratio reduction, the enrichment may initially be to a higher degree and may be tapered off faster as the compression ratio is reduced to the threshold ratio.

Once a threshold duration (or threshold distance or threshold number of combustion events) has elapsed with no incidence of pre-ignition, the engine load limiting may be reversed first and the engine may be operated at regular air loads. Next, the compression ratio may be returned to the nominal level and enrichment may be discontinued. By relying on compression ratio adjustments via piston displacement before relying on cylinder enrichment or load limiting to address pre-ignition, the instantaneous pre-ignition mitigating effect of the change in piston displacement can be advantageously used to mitigate abnormal combustion while maintaining the combustion air-fuel ratio at or around stoichiometry. By reducing reliance on engine enrichment, fuel economy and engine performance benefits are achieved. It will be appreciated that when only compression ratio reduction takes place, spark timing may be set to be at MBT or BDL limit for the new lower compression ratio (or to whichever has the most retarded spark timing). In comparison, if cylinder enrichment is also used along with the compression ratio adjustment, the spark advance may have an adder adjustment to the MBT or BDL spark at the new compression ratio taking into account the additional cooling provided from running rich.

In still further embodiments, in response to the indication of pre-ignition, a combination of transient enrichment and compression ratio reduction via piston displacement adjustments may be applied. For example, during conditions when the piston displacement and resulting change in compression ratio occurs with a slower response rate, such as at higher engine speeds, a larger amount of transient enrichment may be applied to address the pre-ignition. The larger amount of transient enrichment may include enriching for a longer duration, enriching to a higher degree of richness (or more rich air-fuel ratio), enriching for a larger number of enrichment cycles, and/or enriching the pre-ignition affected cylinder and one or more additional cylinders. In another example, during conditions when the piston displacement and resulting change in compression ratio occurs with a faster response rate, such as at lower engine speeds, a smaller amount of transient enrichment may be applied to address the pre-ignition, the smaller amount of transient enrichment including enriching for a shorter duration, enriching to a lower degree of richness (or less rich air-fuel ratio), enriching for a smaller number of enrichment cycles, and/or enriching only the pre-ignition affected cylinder.

Thus, during a first condition, such as at lower engine speeds, responsive to pre-ignition, a controller may reduce an engine compression ratio by a larger amount without enriching the engine. Then, once the compression ratio has been reduced to a compression ration limit, in response to further pre-ignition, the controller may limit engine load and/or transiently enrich the engine. In comparison, during a second condition, such as at higher engine speeds, responsive to pre-ignition, the controller may reduce the engine compression ratio by a smaller amount while concurrently enriching the engine. Then, once the compression ratio has been reduced to the compression ratio limit, the controller may reduce the enrichment while maintaining the compression ratio at the limit. In response to further pre-ignition, the controller may limit the engine load, and/or enrich the engine.

During the second condition, the enrichment may be initially higher and may be gradually reduced or tapered off as the compression ratio is moved to the desired lower compression ratio level. The ratio of compression ratio reduction to enrichment applied during the second condition may be proportional to engine speed.

The engine load limiting performed after the compression ratio has been reduced to the threshold ratio may be based on the compression ratio reduction and any cylinder enrichment that is performed. For example, the enrichment is determined based on the pre-ignition intensity (e.g., knock sensor output intensity in the pre-ignition window) and the compression ratio reduction, and if the determined enrichment is more than a threshold (e.g., richer than a threshold AFR, or if a number of enrichment cycles is higher than a threshold number), load limiting may be triggered. The load limiting may then be adjusted as a function of the determined cylinder enrichment such as that load limit of the engine is increased as the determined enrichment increases. As such, this may be performed as a parallel evaluation based on the output of a look-up table. Therein, if the number of enrichment cycles is determined to be higher than a threshold (e.g., higher than 0), it triggers adjustments including load limiting and spark advance. The output of a rate incrementer is then used to determine load limiting. For example, if the output of the rate incrementer is higher than a threshold (e.g., higher than 0), it triggers adjustments including load limiting.

As an example, the controller may start with a load limit determined in a feed-forward manner based on engine operating conditions, such as based on an engine speed-load conditions. This load limit may then be clipped based on various factors so as to minimize negative NVH issues associated with abnormal combustion, such as those associated with low speed pre-ignition events. In addition to controlling NVH, engine damaging knock events are also minimized. The controller may use three sets of tables including a nominal table based on nominal conditions, a high effectiveness table (which has a higher effect on abnormal combustion mitigation and generates higher torque output), and a low effectiveness table (which has a lower effect on abnormal combustion and generates a lower torque output). Each of the tables may be plotted as a function of manifold charge temperature (MCT) and engine speed (Ne), and the output of each table is a load clip. The load limit is then clipped with the load clip to blend the outputs of tables.

Specifically, a multiplication factor is used to adjust the load clips output from tables and interpolate between the low, nominal, and high effectiveness tables. The multiplication factor may range from −1 to 1. The factor may be based on various feed-forward measurements. For example, the factor may be based on fuel ethanol or alcohol content, fuel octane content, and air-to-fuel ratio. Thus, a lean air-to-fuel ratio or a low octane fuel that will make the probability of abnormal combustion go higher results in a load clip wherein the interpolation of the load clip moves the load limit to a lower value. In another example, a rich air-to-fuel ratio or a high octane content of the fuel may result in a higher load limit since the enrichment reduces the probability of abnormal combustion. The load clip is also based on a rate of abnormal combustion, such as a rate of pre-ignition (herein also referred to as PI rate). The PI rate may be learned as a function of knock sensor output intensity and engine speed.

The load clip also includes the feedback portion of the load limiting, wherein the load limit is further adjusted based on PI rate. Therein, the PI rate may be incremented on a rate counter based on engine speed and knock sensor output intensity. The rate counter or weighting is incremented as the degree of enrichment or number of enrichment cycles applied in response to the output of a knock sensor in a defined window increases, and further based on an engine speed at which the knock sensor signal is detected. As the number of abnormal combustion events per vehicle miles driven increases, the rate may be further incremented. The rate may be decreased as the number of miles driven by the vehicle engine increases. As such, with enough miles, the rate can come back to zero and have no effect on load limiting if no abnormal combustion is observed. However, the operating conditions can affect the anticipation of abnormal combustion and hence the nominal load limit. The torque load limit is then arbitrated with the load clip by the controller to determine the arbitrated torque load limit.

In parallel, a rate incrementer may be counting the number of enrichment cycles performed in response to an abnormal combustion event. The number of enrichment cycles may be determined as a function of an output intensity of a knock sensor in the defined first window and an engine speed at which the knock sensor output is received. For example, as the knock sensor output intensity in the defined window increases, the number of enrichment cycles may be increased and the rate incrementer may be incremented by a defined amount. Alternatively, a weighting factor may be determined. If the rate incrementer output is high (e.g., higher than a threshold), or if the weighting factor is high (e.g., higher than a threshold), a weighted engine load limit may be calculated. This weighted engine load limit may have a more aggressive "learn down rate" and may be activated only when a threshold number of enrichment cycles have been used.

As an example, a number of enrichment cycles to be performed may be determined as a function of the output intensity of the knock sensor in the first window and an engine speed at which the knock sensor output is received. If the number of enrichment cycles is not higher than a threshold (e.g., higher than 0), the engine may continue running with the normal fuel strategy. For example, the engine cylinders may continue to be operated at stoichiometry. Else, if the number of enrichment cycles determined is higher, then air-fuel control for the abnormal combustion affected cylinders is adjusted so that the desired degree of richness can be provided. During the arbitration of torque load limits, the controller may first determine torque load limits under different conditions, such as a combustion stability limited load limit, a cold condition combustion stability limited load limit, as well as an interpolated torque load limit that corresponds to the load clipped torque load limit discussed above. The controller may arbitrate the load limits and select the desired load limit to be the lowest (that is, minimum) of load limits. The arbitrated load limit then undergoes air mass to torque conversion. In addition, other weighted engine load limits are learned. These include, for example, transmission torque limits and traction control limits. The controller may arbitrate the torque limits and select the final driver demanded torque to be the lowest (that is, minimum) of the determined load limits and the air mass to torque converted arbitrated load limit.

Thus, the final driver demanded torque may be the lowest of the interpolated torque limit and the weighted engine torque limit. Herein, the weighted engine torque limit may be more restrictive than the arbitrated torque load limit, but may vary relative to each other based on engine speed. For example, at low engine speeds, where pre-ignition is likely to occur, the weighted engine load limit may be the most restrictive. In comparison, at higher engine speeds, such as when knock is likely to occur, the clipped torque load limit may be the most restrictive. For example, the load clip may be more restrictive at lower engine speeds, and higher at medium to higher engine speeds. By selecting the lowest of the possible load limits, abnormal combustion is mitigated and further mega-knock events are pre-empted while addressing all other load affecting constraints.

Figure 7:
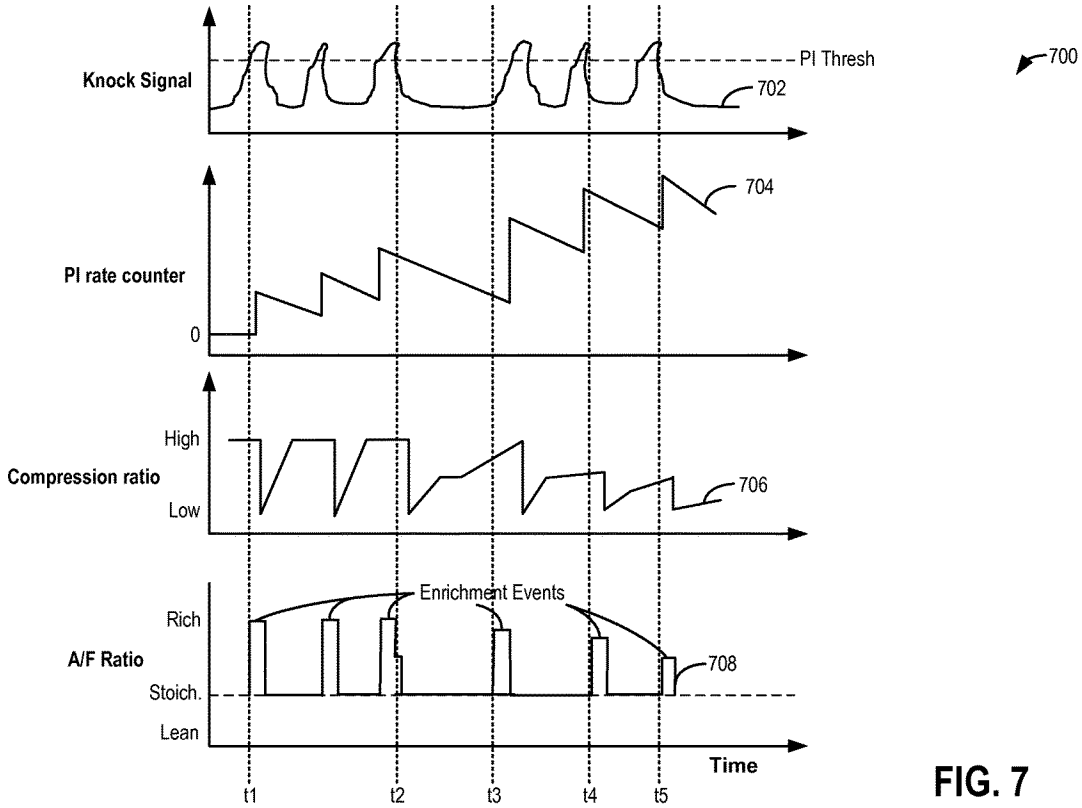
FIG. 7 shows an example pre-ignition mitigating operation that relies at least partly on piston displacement and the resulting change in engine compression ratio.

Now turning to FIG. 7, an example pre-ignition mitigation via adjustments to a compression ratio of a variable compression ratio engine having variable piston displacement capabilities is shown. Map 700 depicts a knock sensor output in a pre-ignition window at plot 802, the output of a PI rate counter at plot 704, a change in compression ratio at plot 706, and pre-ignition mitigating engine enrichment cycles at plot 708. All plots are shown over time along the x-axis.

Prior to t1, the engine may be operating with a nominal compression ratio (high) based on engine operating conditions. In addition, due to a lower than threshold PI count (herein 0) prior to t1, no further reduction of the compression ratio from the nominal level to a lower feedback level is performed.

Between t1 and t2, a plurality (herein three) of distinct pre-ignition events may be confirmed based on the knock sensor output in the pre-ignition window exceeding a PI threshold (dashed line). In response to each distinct pre-ignition event, the compression ratio is immediately reduced from the nominal level to a predefined mitigation level (low). Specifically, each time pre-ignition is confirmed, the compression ratio is immediately reduced to the same low mitigation level. Further, following the reduction to the mitigation level, the engine (or at least the affected cylinder) is enriched for a duration while the compression ratio is gradually returned to the nominal (high) level. In some examples, due to the ability to change the compression ratio, the compression ratio is reduced first and the enrichment is used next. In other examples, due to the inability to change the compression ratio rapidly, the cylinder is enriched first and the compression ratio is reduced next, with the enrichment decreased as the compression ratio reduction is initiated.

Between t2 and t3, no indication of pre-ignition is confirmed. Thus, between t2 and t3, as a duration (or number of combustion events or travelled distance) elapses with no occurrence of pre-ignition, the output of the PI rate counter is decremented. In addition, the compression ratio is gradually increased. However, the compression ratio is not returned to the nominal level. Instead, due to the pre-ignition history of the engine (and the output of the PI counter indicating a propensity of the engine to pre-ignite), even when no indication of pre-ignition is received, the compression ratio is maintained at a feedback level that is lower than the nominal (high) level but higher than the mitigation (low) level. As such, no pre-emptive enrichment is applied during this time. By using the compression ratio reduction to the feedback level, the need for pre-emptive enrichment is reduced, providing fuel economy benefits while lowering the propensity for abnormal combustion.

At t3, even with the feedback reduction in compression ratio, an incidence of pre-ignition is confirmed. Consequently, the PI rate counter is incremented. In addition, the compression ratio is immediately reduced from the feedback level to the mitigation level while the cylinder is concurrently enriched. However, due to the use of concurrent compression ratio reduction and enrichment, a smaller degree of enrichment is applied (and/or for a smaller number of enrichment cycles and to a smaller number of engine cylinders, such as to only the affected cylinder). As the enrichment is applied, the compression ratio reduction is tapered out and the compression ratio is returned to the feedback level. However, the compression ratio is still not returned to the nominal level due to the higher PI count of the engine.

At t4, another incidence of pre-ignition is confirmed. Consequently, the PI rate counter is incremented further to indicate intermittent pre-ignition. In addition, the compression ratio is immediately reduced from the feedback level to the mitigation level while the cylinder is concurrently enriched. The compression ratio is then held at the mitigation level for a longer duration (compared to the duration applied at t3) while a still smaller degree of concurrent enrichment is applied (specifically, to a smaller degree of richness as compared to the degree of richness applied at t3). As the enrichment is applied, the compression ratio reduction is tapered out and the compression ratio is returned to the feedback level at a slower rate. The compression ratio is still not returned to the nominal level due to the higher PI count of the engine.

At t5, still another incidence of pre-ignition is confirmed. Consequently, the PI rate counter is incremented even further to indicate persistent pre-ignition. In addition, the compression ratio is immediately reduced from the feedback level to the mitigation level while the cylinder is concurrently enriched. The compression ratio is then held at the mitigation level for a still longer duration (compared to the duration applied at t4) while a still smaller degree of concurrent enrichment is applied (specifically, to a smaller degree of richness as compared to the degree of richness applied at t3). As the enrichment is applied, the compression ratio reduction is tapered out and the compression ratio is returned to the feedback level at a slower rate. The compression ratio is still not returned to the nominal level due to the higher PI count of the engine.

As an example, a method for an engine may include reducing an engine compression ratio from a first, nominal level to a second level based on a pre-ignition history of the engine and before an incidence of pre-ignition on a current engine cycle. The method may further include reducing the engine compression ratio from the second level to a third level responsive to the incidence of pre-ignition on the current engine cycle. Herein, the reduction from the first level to the second level is smaller than the reduction from the second level to the third level. Further, in response to no indication of pre-ignition being received after one of a threshold duration, a threshold distance, and a threshold number of combustion events having elapsed since the incidence of pre-ignition, increasing the engine compression ratio towards the first level. As used herein, reducing the engine compression ratio may include reducing the displacement of a piston within a cylinder via an eccentric in an area of a piston pin and increasing a distance between a top of the piston from a cylinder head. The third level is a threshold level. The method further comprises, in response to a further indication of pre-ignition, enriching the engine and limiting an engine load while maintaining the compression ratio at the third level.

In a further representation, pre-ignition may be reduced by adjusting an eccentric coupled to a piston pin of a variable compression ratio engine responsive to an indication of pre-ignition to reduce a displacement of the piston within a combustion chamber, thereby reducing an effective volume of the cylinder when the piston is at TDC relative to BDC. As such, the reducing of the compression ratio also increase an effective distance between the piston head and the cylinder head.

In this way, piston displacement may be advantageously varied to reduce a compression ratio and mitigate abnormal combustion due to pre-ignition. By coordinating the change in compression ratio with other mitigating actions such as enrichment and load limiting, pre-ignition may be addressed with a smaller amount of enrichment (for example, no enrichment) and with no adverse effect on engine performance. As such, this allows pre-ignition to be addressed while maintaining engine combustion at stoichiometry and spark timing closer to MBT. By leveraging the rapid effect of a drop in compression ratio on pre-ignition, abnormal combustion may be mitigated earlier, improving engine life.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

in response to an indication of pre-ignition, adjusting a piston displacement to reduce an engine compression ratio, wherein the indication of pre-ignition comprises one or more of a pre-ignition count of the engine, an output of a knock sensor, an intensity of pre-ignition, an amplitude of pre-ignition, and a frequency of pre-ignition, for more than one previous engine cycle, and wherein an amount that the compression ratio is reduced is based on the indication of pre-ignition and engine speed, wherein a smaller piston displacement and a smaller reduction in compression ratio is applied when the indication of pre-ignition is at a higher engine speed and wherein a larger piston displacement and a larger reduction in compression ratio is applied when the indication of pre-ignition occurs at a lower engine speed;

in a first mode, enriching the engine above stoichiometry while reducing the compression ratio; and in a second mode, enriching the engine above stoichiometry after reducing the compression ratio, once the compression ratio has been reduced to a threshold minimum below which the compression ratio is not further reduced, wherein the amount of the enrichment is greater in the second mode than the first mode, and wherein the enrichment is tapered off more quickly in the second mode than the first mode.

2. The method of claim 1, wherein the adjusting includes reducing the compression ratio to a greater extent towards a threshold ratio as the indication of pre-ignition increases.

3. The method of claim 2, further comprising maintaining each of a fuel injection timing, spark timing, and valve timing while the compression ratio is reduced.

4. The method of claim 2, wherein the piston displacement and the reduction in compression ratio are further based on an engine speed at which the indication of pre-ignition was received, and wherein the compression ratio is a static compression ratio.

5. The method of claim 2, wherein adjusting the piston displacement to reduce the compression ratio includes reducing the piston displacement within a compression chamber via one of an elliptical crankshaft rotation and an eccentric coupled to a piston pin.

6. The method of claim 5, further comprising, after reaching the threshold ratio, in response to a further indication of pre-ignition, enriching the engine and/or limiting an engine load by reducing intake airflow, each of the enrichment and the engine load limiting based on the reduction in compression ratio.

7. The method of claim 6, further comprising, in response to no further indication of pre-ignition, increasing the piston displacement to increase the compression ratio from the threshold ratio.

8. A method for an engine, comprising:

responsive to an indication of pre-ignition, reducing a compression ratio via adjustments to a piston displacement within a compression chamber, wherein the reducing of the compression ratio is further based on an engine speed at which the indication of pre-ignition is received, wherein the compression ratio is reduced by a higher amount at lower engine speeds; and enriching the engine above stoichiometry and/or limiting an intake airflow, wherein the enriching is performed during and after the reducing the compression ratio at higher engine speeds and is only performed after reducing the compression ratio to a threshold compression ratio at the lower engine speeds, wherein an amount that the engine is enriched is greater at the lower engine speeds than at the higher engine speeds, and wherein the enrichment is tapered off more quickly at the lower engine speeds than at the higher engine speeds.

9. The method of claim 8, wherein the indication of pre-ignition includes a frequency of pre-ignition, and wherein reducing the compression ratio includes reducing the compression ratio at a higher rate when the pre-ignition is persistent and reducing the compression ratio at a lower rate when the pre-ignition is intermittent.

10. The method of claim 8, wherein reducing the compression ratio via adjustments to the piston displacement includes reducing the piston displacement within the compression chamber to reduce the compression ratio.

11. The method of claim 10, further comprising maintaining each of fuel injection timing, spark timing, and valve timing while reducing the compression ratio, and adjusting one or more of the fuel injection timing, spark timing, and valve timing while enriching the engine and/or limiting the intake airflow.

12. The method of claim 11, further comprising, in response to no further indication of pre-ignition received after enriching the engine and/or limiting the intake airflow, increasing the compression ratio by increasing the piston displacement within the compression chamber.

13. A method for an engine, comprising:

reducing an engine compression ratio from a first, nominal level to a second level by an amount based on an engine speed and a pre-ignition history of the engine and before an incidence of pre-ignition on a current engine cycle, wherein the pre-ignition history comprises one or more of a pre-ignition count of the engine, an output of a knock sensor, an intensity of pre-ignition, an amplitude of pre-ignition, and a frequency of pre-ignition, for more than one previous engine cycle, wherein the engine compression ratio is reduced by a greater amount at lower engine speeds;

reducing the engine compression ratio from the second level to a third level responsive to the incidence of pre-ignition on the current engine cycle;

in a first mode, enriching the engine above stoichiometry while reducing the engine compression ratio from the second level to the third level and continuing to enrich the engine above stoichiometry after reducing the engine compression ratio to the third level responsive to further indications of pre-ignition while maintaining the engine compression ratio at the third level; and in a second mode, enriching the engine above stoichiometry after reducing the engine compression ratio to the third level responsive to a further indication of pre-ignition while maintaining the engine compression ratio at the third level, wherein an amount of transient enrichment is larger in the first mode than in the second mode, and wherein the enrichment is tapered off more slowly in the first mode than in the second mode.

14. The method of claim 13, wherein the reduction from the first level to the second level is smaller than the reduction from the second level to the third level.

15. The method of claim 14, further comprising, in response to no indication of pre-ignition being received after one of a threshold duration, a threshold distance, and a threshold number of combustion events having elapsed since the incidence of pre-ignition, increasing the engine compression ratio towards the first level.

16. The method of claim 13, wherein reducing the engine compression ratio includes reducing a displacement of a piston within a cylinder via an eccentric in an area of a piston pin and increasing a distance between a top of the piston and a cylinder head.

17. The method of claim 13, wherein the third level is a threshold level, further comprising, in response to a further indication of pre-ignition, limiting an engine load while maintaining the engine compression ratio at the third level.

18. The method of claim 13, wherein the amount of transient enrichment is increased by one or more of: enriching for a longer duration, enriching at a richer air-fuel ratio, and enriching for a larger number of enrichment cycles.

* * * * *